US007468666B2

(12) United States Patent
Ciarcia, Jr. et al.

(10) Patent No.: US 7,468,666 B2
(45) Date of Patent: Dec. 23, 2008

(54) SYSTEMS AND METHODS FOR PROVIDING SECURE ENVIRONMENTS

(75) Inventors: Daniel J. Ciarcia, Jr., Malabar, FL (US); Michael J. McHugh, Dracut, MA (US)

(73) Assignee: Secure Care Products, Inc., Concord, NH (US)

( * ) Notice: Subject to any disclaimer, the term of this patent is extended or adjusted under 35 U.S.C. 154(b) by 88 days.

(21) Appl. No.: 11/610,557

(22) Filed: Dec. 14, 2006

(65) Prior Publication Data

US 2007/0085683 A1 Apr. 19, 2007

Related U.S. Application Data

(62) Division of application No. 10/768,300, filed on Jan. 30, 2004, now Pat. No. 7,167,094.

(60) Provisional application No. 60/444,089, filed on Jan. 31, 2003.

(51) Int. Cl.
*G08B 13/00* (2006.01)

(52) U.S. Cl. ..... 340/568.1; 340/541; 340/542; 340/545.9

(58) Field of Classification Search ..... 340/568.1, 340/541, 545.1, 565, 540, 542, 545.7, 545.9
See application file for complete search history.

(56) References Cited

U.S. PATENT DOCUMENTS

| | | | | |
|---|---|---|---|---|
| 4,689,610 | A * | 8/1987 | Dietrich | 340/515 |
| 4,962,473 | A * | 10/1990 | Crain | 340/541 |
| 5,543,797 | A * | 8/1996 | Hochstein et al. | 340/10.2 |
| 6,396,413 | B2 * | 5/2002 | Hines et al. | 340/825.49 |
| 6,433,687 | B1 * | 8/2002 | Yamaashi et al. | 340/573.1 |
| 6,693,543 | B1 * | 2/2004 | Stephenson et al. | 340/572.9 |
| 6,917,288 | B2 * | 7/2005 | Kimmel et al. | 340/511 |
| 6,965,317 | B2 * | 11/2005 | Fujimoto | 340/573.1 |

* cited by examiner

*Primary Examiner*—Toan N Pham
(74) *Attorney, Agent, or Firm*—Hayes Soloway PC

(57) ABSTRACT

A system and method for monitoring a facility is provided. Generally, the system comprises monitoring tags wherein each monitoring tag emits an identifier signal unique to each monitoring tag, monitoring sensors wherein the monitoring sensors receive signals from the monitoring tags and relay the signals to one or more monitoring stations, and monitoring stations wherein the monitoring stations log and display information associated with the signals received. The monitoring station identifies possible events based on the signals received from the monitoring sensors. The monitoring station alerts staff members of the events via a graphical user interface, pagers, email, and alarms.

40 Claims, 8 Drawing Sheets

SYSTEMS AND METHODS FOR PROVIDING SECURE ENVIRONMENTS

CROSS-REFERENCE TO RELATED APPLICATION

This application is a divisional of application Ser. No. 10/768,300 filed Jan. 30, 2004 which claimed priority to U.S. Provisional Application entitled, "System and Methods for Providing Secure Environments," having Ser. No. 60/444,089 filed Jan. 31, 2003, which is entirely incorporated herein by reference.

FIELD OF THE INVENTION

The present invention is generally related to a method and system for providing security to facilities, and more particularly, is related to a method and system for monitoring individuals within a facility.

BACKGROUND OF THE INVENTION

Security is of major importance in most facilities. A secure facility requires keeping track of individuals and items within the facility. A common system of providing security to a facility is to employ security guards at points of exit and entry into the facility. However, employing a large number of security guards can be expensive. Some facilities limit the number of exit and entry points; however, this can restrict the flow of traffic into and out of the facility. In addition to the need to monitor exit and entry points, some facilities have sensitive areas within the facility where access is restricted for some persons who are permitted access to other parts of the facility. Facilities with sensitive areas would further require additional security for each sensitive area. In addition to the cost of employing a large number of security guards, the security guards must also be constantly updated with regard to which individuals are allowed access to each area.

Security cameras have been employed to monitor facilities. However, security cameras still rely on guards to monitor the security cameras. A security guard viewing a monitor for a security camera may mistake a person not permitted access for a person permitted access, A distracted security guard also may not notice a person entering or exiting the facility. The security cameras still do not alleviate the need to constantly update security guards on who is allowed access.

Many faculties rely on locked doors to prevent access to the overall facility and sensitive areas within the facility. Individuals of the facility are given keys or codes to gain access through locked doors. However, this requires individuals to keep track of multiple codes or keys. As a result individuals often prop open doors to high traffic areas, rendering the security measure obsolete. In addition, as new individuals are given access and past individuals are no longer permitted access, the facility must continuously update codes and locks, There exists a need for a monitoring system that keeps track of individuals throughout a facility. Such a system would allow administrators to easily update persons allowed access and not permitted access, and would alert staff members when an individual is or has attempted to access an area in which the individual is not permitted. Similarly, such a system can alert a staff member of suspicious movement of individuals based on a pattern of movement. Thus, a heretofore unaddressed need exists in the industry to address the aforementioned deficiencies and inadequacies.

SUMMARY OF THE INVENTION

Embodiments of the present invention provide a system and method for monitoring. Briefly described, in architecture, one embodiment of the system, among others, can be implemented as follows. The monitoring system contains one or more monitoring tags wherein each monitoring tag emits an identifier signal unique to each monitoring tag. One or more monitoring sensors are also provided wherein one or more of the monitoring sensors receive signals from the one or more monitoring tags and relay the signals to one or more monitoring stations, and one or more monitoring stations wherein the one or more monitoring stations log and display information associated with the signals received from the one or more monitoring stations.

In another embodiment, the monitoring system has a Graphical User Interface (GUI) for a monitoring system. The GUI contains a map associated with a monitored area, one or more monitoring sensor icons located on the map in a location associated with a monitoring sensor in the monitored area, and one or more event icons located on the map in a location associated with a monitored event in the monitored area.

The present invention can also be viewed as providing methods for monitoring. In this regard, one embodiment of such a method, among others can be broadly summarized by the following steps: receiving a unique identifier signal from one or more monitoring tags, receiving an alert signal from one or more monitoring tags; identifying a situation based on one of the identifier signals and alert signals; and storing and displaying the situation.

Other systems, methods, features, and advantages of the present invention will be or become apparent to one with skill in the art upon examination of the following drawings and detailed description. It is intended that all such additional systems, methods, features, and advantages be included within this description, be within the scope of the present invention, and be protected by the accompanying claims.

BRIEF DESCRIPTION OF THE DRAWINGS

Many aspects of the invention can he better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION

Figure 1:
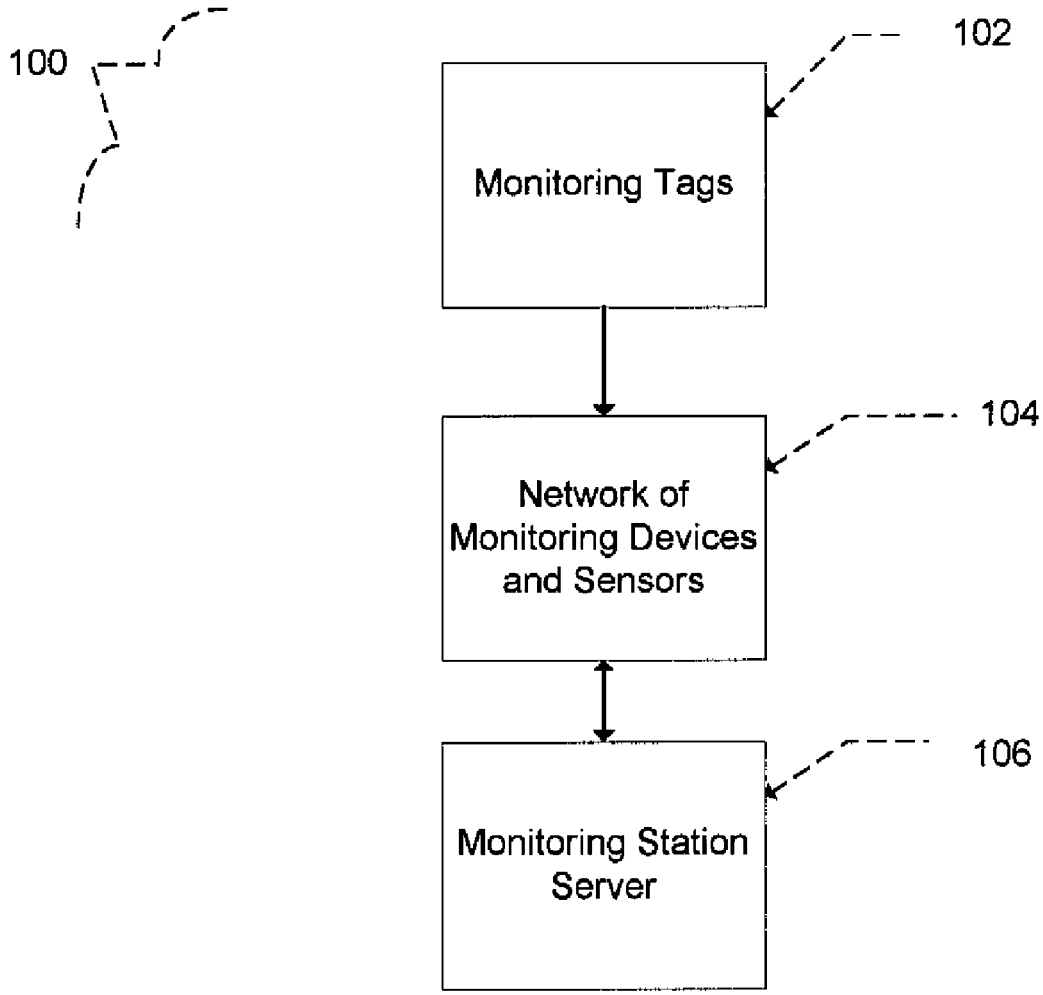
FIG. 1 is a block diagram illustrating general interaction of components of a monitoring system, in accordance with a first exemplary embodiment of the invention.

The present monitoring system provides individuals using the system, such as, but not limited to, staff members, with a central location for monitoring and managing movement of persons or items within a facility. FIG. 1 is a block diagram illustrating general interaction of the components of the monitoring system 100, in accordance with a first exemplary embodiment of the invention. Each person or item being monitored wears a monitoring tag 102. Each monitoring tag 102 broadcasts a unique identification signal having a specific radio frequency. A network of monitoring devices and sensors 104 transmits information back to a monitoring station server 106. The monitoring station server 106 alerts staff members based on the information from the monitoring components and predetermined procedures.

The monitoring tag 102 is connected to each item or individual being monitored. The monitoring tag 102 broadcasts an identification signal that can be received by other components of the monitoring system 100. Each monitoring tag 102 transmits an identification signal that is unique to that specific monitoring tag 102. When the monitoring station server 106 receives the unique signal, the monitoring station server 106 associates the unique signal with information about the item or person wearing the monitoring tag 102. The monitoring tags 102 are described in greater detail in U.S. Pat. No. 5,543,780 and incorporated herein in its entirety.

Most of the examples described herein are associated with a person wearing the monitoring tag 102, however, it should be apparent that the monitoring system 100 can also be connected to items and used to track the movement of items throughout a facility. For example, radioactive material in a hospital can be stored within a container that also has a monitoring tag 102 connected to the container. The monitoring system 100 would allow hospital staff to track the location of the material within the facility.

The monitoring tag 102 can also transmit an alert signal. The alert signal is broadcasted by transmitting a wireless signal, for example but not limited to, radio frequency (RF). The wireless signal indicates that a problem has occurred with the monitoring tag 102. Since the alert signal does not broadcast continuously, in contrast to the identification signal but instead broadcasts when the monitoring tag 102 detects a problem. The monitoring tag 102 can broadcast a more powerful alert signal without depleting power resources of the monitoring tag 102, such as a battery.

In one example, the monitoring tag 102 can be strapped to an individual or item. When the strap is removed or broken the monitoring tag 102 begins transmitting the alert signal. When the monitoring station server 106 receives the alert signal, the monitoring station server 106 can then take corrective action, for example, sounding an alarm or locking exit doors. In addition to broadcasting the alert signal for communicating that the monitoring tag 102 has been removed from the individual or item, the alert signal can also be broadcasted to communicate to the monitoring station server 106 that the monitoring tag 102 is in need of maintenance. As one example, an alert signal may be broadcasted in a power source of the monitoring tag needs to be restored. The alert signal can also be used to communicate that a container storing an item has been opened, as in the radioactive material example discussed above.

In a specific example, the monitoring tag 102 is a wrist or ankle band. A transmitter is attached to the wrist or ankle band. An electrical circuit encircles the wrist or ankle band. When the wrist or ankle band is broken or removed the electrical circuit is broken and the monitoring tag 102 broadcasts the alert signal. The monitoring tags 102 can also use other methods for detecting proximity to a user as described in greater detail in U.S. Pat. No. 5,543,780, which is incorporated herein in its entirety. Both the identification signals and alert signals may be transmitted to monitoring devices and sensors 104 using radio frequencies (RF) The radio frequencies operate in a safe and secure range. When the circuit is broken the transmitter begins broadcasting the alert signal. This indicates to the monitoring station server 106 that the monitoring tag 102 may no longer be connected to the user. It should be apparent that although this example describes using radio frequency, a variety of other wireless communications medium could be employed. Although this example describes a monitoring tag 102 that is connected to the user, the monitoring tag 102 can be attached to an employee identification card (ID). The ID can then be carried in the employee's pocket or displayed on the employee's uniform. It should also be noted that the identification signals and alert signals may be transmitted using other transmission means known to one having ordinary skill in the art.

Figure 2:
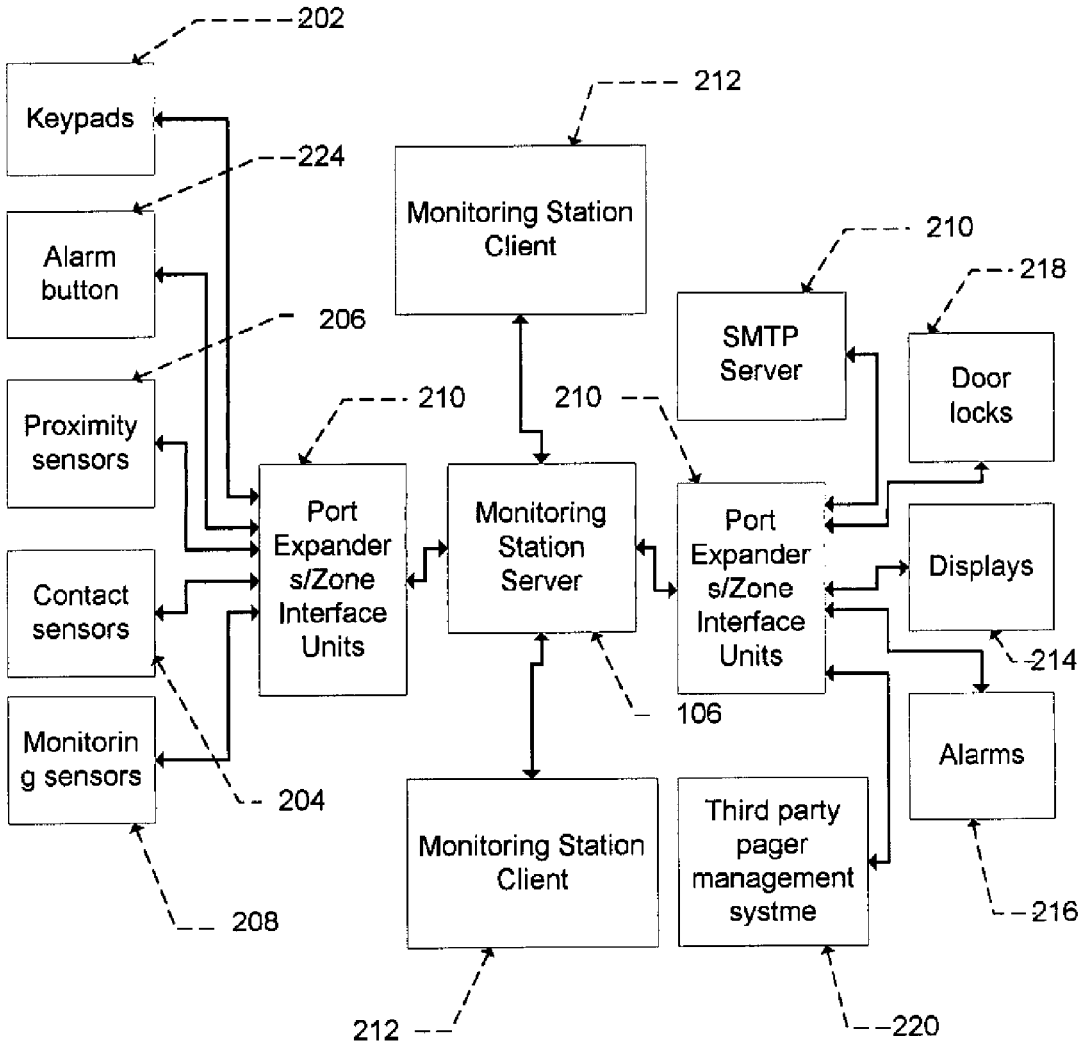
FIG. 2 is a block diagram illustrating interaction of the components of the monitoring system of FIG. 1.

FIG. 2 is a block diagram illustrating interaction of the specific components of the monitoring system 200 of FIG. 1. The monitoring station server 106 receives signals from the monitoring devices and sensors 104. A keypad 202 is an example of a monitoring device and sensor 104 that can be used to allow access through an entryway by having a user enter a correct code. The monitoring station server 106 can be used in conjunction with the keypad 202 to update the keypad codes during security updates. The monitoring station server 106 can deny access to properly entered codes during periods in which no access is permitted by any individual or during periods of alert.

Contact sensors 204 can also be incorporated into the monitoring devices and sensors 104. Contact sensors 204 can be mounted to, for example but not limited to, windows and doors. An example of a contact sensor 204 is a two-pole switch that opens a circuit when a window or door is opened. The open circuit signals that the door or window has been opened. Other examples of contact sensors can include magnetic switches or other devices known in the art. When the window or door is opened or closed, a switch is activated signaling that the door or window has been opened or closed. Not only can the contact sensors 204 detect that a door has been opened, but they can also detect that an attempt has been made to open the door. In this example, the contact sensor 204 is connected to a doorknob or handle. The contact sensor 204 detects when the doorknob or handle has been pressed. Therefore, the contact sensor 204 can detect when an attempt to open the door has occurred even though the door is not actually opened. The contact sensors 204 allow the monitoring system 100 to detect, which doors or windows in a facility are opened or closed and whether an individual has attempted to open a door or window.

Figure 3:
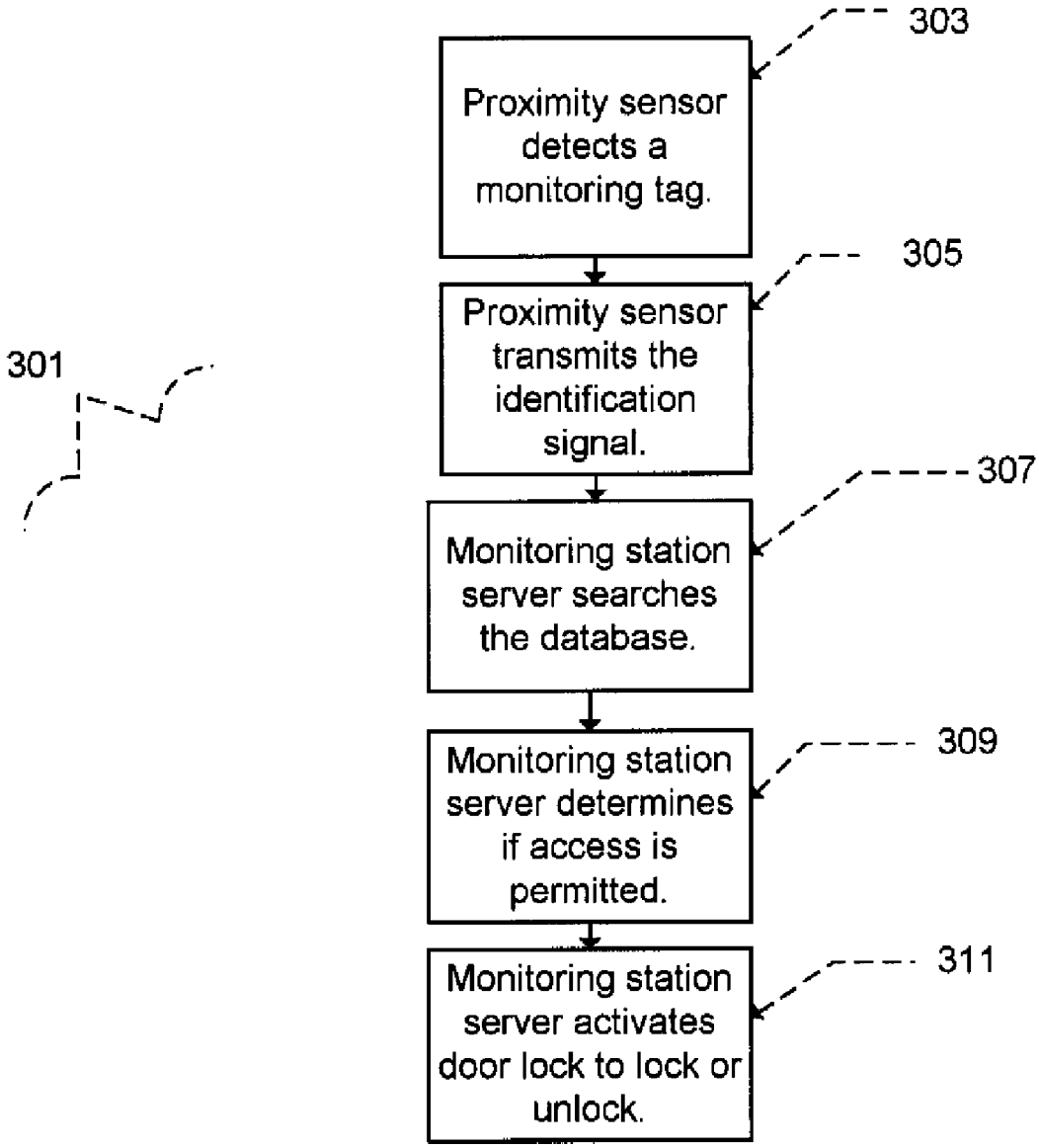
FIG. 3 is a flowchart illustrating a first method of providing access to an entryway within the monitoring system of FIG. 1.

Proximity sensors 206 can also be incorporated into the monitoring devices and sensors 104. The proximity sensors 206 are installed around doors, elevators, and other points of access. FIG. 3 is a flowchart illustrating a first method 301 of providing access to an entryway within the monitoring system of FIG. 1. When the proximity sensor 206 detects a monitoring tag 102 (block 303), the proximity sensor 206 transmits the identification signal for the specific monitoring tag 102 that is near the point of access to the monitoring station server 106 (block 305). The monitoring station server 106 searches the monitoring station server database (as described below) (block 307). From the information in the database the monitoring station server determines if access is permitted (block 309). The monitoring station server 106 can then activate a door lock 218 into an unlocked or locked position based on the specific monitoring tag 102 (block 311). Besides activating the door locks 218, the monitoring station server 106 can also perform other predetermined actions. For example, the monitoring station server 106 can store the specific monitoring tag 102 and the door to which access was attempted into a log in a monitoring station server 106 database. The monitoring station server 106 can also log the amount of time the monitoring tag 102 was in proximity of the door. More examples will be apparent and discussed later as the monitoring system 100 is described herein. In an alternative embodiment, the proximity sensor 206 can directly activate the door lock 218 based on a detected monitoring tag 102. The proximity sensor 206 can store the monitoring tags 102 that are not permitted access in an internal memory.

Functions performed by the monitoring station server 106, as described herein, can be implemented by software (e.g., firmware), hardware, or a combination thereof The functionality is preferably implemented in software, as an executable program, and is executed by a special or general purpose digital computer, such as a personal computer (PC; IBM-compatible, Apple-compatible, or otherwise), workstation, minicomputer, or mainframe computer, namely, the monitoring station server 106. An example of a general purpose computer that can implement the software of the present invention is shown in the block diagram of FIG. 4, In FIG. 4, the software that defines functionality performed by the monitoring system 100 is denoted by reference numeral 250.

Figure 4:
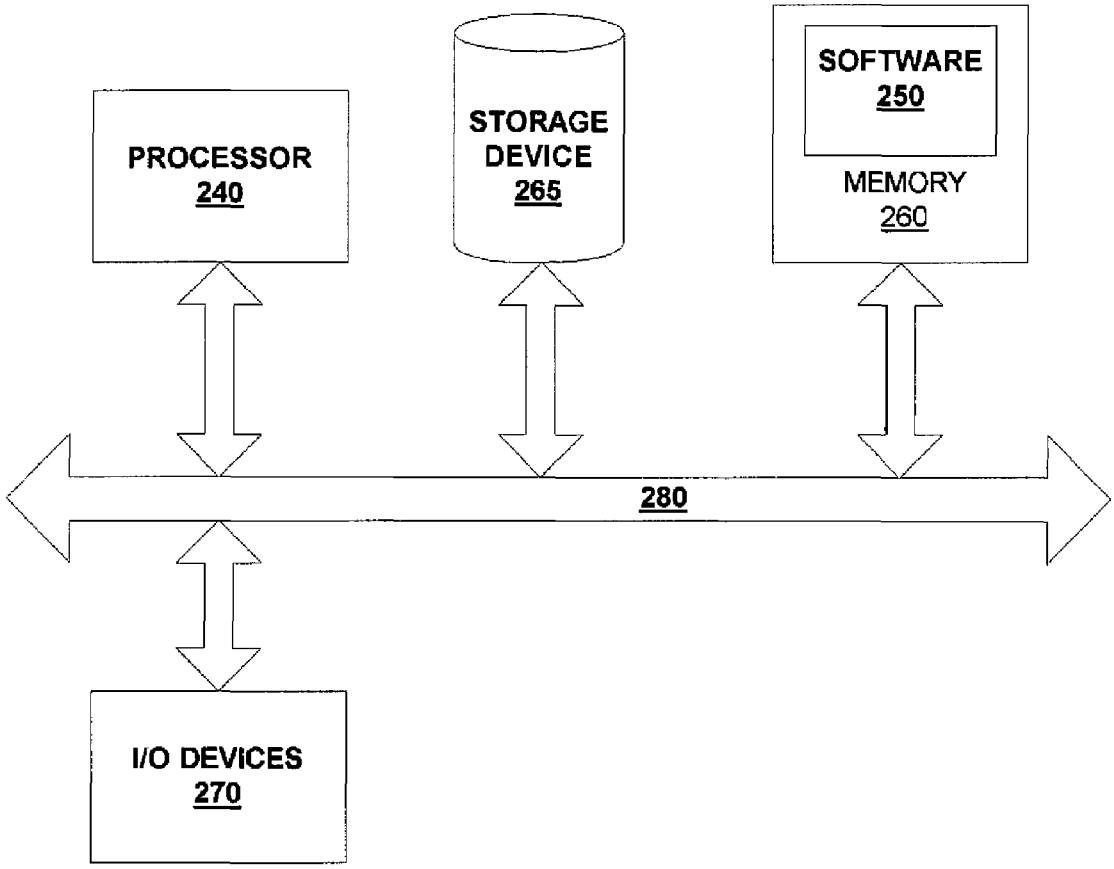
FIG. 4 is a block diagram illustrating an example of a general purpose computer that can implement software of the present invention.

Generally, in terms of hardware architecture, as shown in FIG. 4, the computer 106, or server, includes a processor 240, memory 260, and one or more input and/or output (I/O) devices 270 (or peripherals) that are communicatively coupled via a local interface 280. The local interface 280 can be, for example but not limited to, one or more buses or other wired or wireless connections, as is known in the art. The local interface 280 may have additional elements, which are omitted for simplicity, such as controllers, buffers (caches), drivers, repeaters, and receivers, to enable communications. Further, the local interface may include address, control, and/or data connections to enable appropriate communications among the aforementioned components. It should be noted that the computer 106 may also have a storage device 265 therein. The storage device 265 may be any nonvolatile memory element (e.g., ROM, hard drive, tape, CDROM, etc.).

The processor 240 is a hardware device for executing the software 250, particularly that stored in memory 260. The processor 240 can be any custom made or commercially available processor, a central processing unit (CPU), an auxiliary processor among several processors associated with the monitoring station server 106, a semiconductor based microprocessor (in the form of a microchip or chip set), a macroprocessor, or generally any device for executing software instructions. Examples of suitable commercially available microprocessors are as follows: a PA-RISC series microprocessor from Hewlett-Packard Company, an 80×86 or Pentium series microprocessor from Intel Corporation, a PowerPC microprocessor from IBM, a Sparc microprocessor from Sun Microsystems, Inc, or a 68 automated self-service series microprocessor from Motorola Corporation.

The memory 260 can include any one or combination of volatile memory elements (e.g., random access memory (RAM, such as DRAM, SRAM, SDRAM, etc.)) and nonvolatile memory elements. Moreover, the memory 260 may incorporate electronic magnetic, optical, and/or other types of storage media. Note that the memory 260 can have a distributed architecture, where various components are situated remote from one another, but can be accessed by the processor 240.

The software 250 located in the memory 260 may include one or more separate programs, each of which comprises an ordered listing of executable instructions for implementing logical functions. In the example of FIG. 4, as mentioned above, the software 250 includes functionality performed by the monitoring station server 106 in accordance with the present invention and may include a suitable operating system (O/S). A nonexhaustive list of examples of suitable commercially available operating systems is as follows: (a) a Windows operating system available from Microsoft Corporation; (b) a Netware operating system available from Novell, Inc.; (c) a Macintosh operating system available from Apple Computer, Inc.; (d) a UNIX operating system, which is available for purchase from many vendors, such as the Hewlett-Packard Company, Sun Microsystems, Inc., and AT&T Corporation; (e) a LINUX operating system, which is freeware that is readily available on the Internet; (V) a run time Vxworks operating system from WindRiver Systems, Inc.; or (g) an appliance-based operating system, such as that implemented in handheld computers or personal data assistants (PDAs) (e.g., PalmOS available from Palm Computing, Inc., and Windows CE available from Microsoft Corporation). The operating system essentially controls the execution of other computer programs, such as the software 250 stored within the memory 260, and provides scheduling, input-output control, file and data management, memory management, and communication control and related services. It should be noted that the monitoring station server 106 may also contain a storage device 265, otherwise referred to herein as a database.

The software 250 is a source program, executable program (object code), script, or any other entity comprising a set of instructions to be performed. When a source program, then the program needs to be translated via a compiler, assembler, interpreter, or the like, which may or may not be included within the memory 260, so as to operate properly in connection with the O/S. Furthermore, the software 250 can be written as (a) an object oriented programming language, which has classes of data and methods, or (b) a procedure programming language, which has routines, subroutines, and/or functions, for example but not limited to, C, C++, Pascal, Basic, Fortran, Cobol, Perl, Java, and Ada.

The I/O devices 270 may include input devices, for example but not limited to, a keyboard, mouse, scanner, microphone, touchscreens, etc, Furthermore, the I/O devices 270 may also include output devices; for example but not limited to, a printer, display, etc. Finally, the I/O devices 270 may further include devices that communicate both inputs and outputs, for instance but not limited to, a modulator/demodulator (modem; for accessing another device, system, or network), a radio frequency (RF) or other transceiver, a telephonic interface, a bridge, a router, etc.

If the monitoring station server 106 is a personal computer (PC), workstation, Personal Data Assistant (PDA), or the like, the software 250 in the memory 260 may further include a basic input output system (BIOS) (omitted for simplicity). The BIOS is a set of essential software routines that initialize and test hardware at startup, start the O/S, and support the transfer of data among the hardware devices. The BIOS is stored in ROM so that the BIOS can be executed when the monitoring station server 106 is activated.

When the computer 106 is in operation, the processor 240 is configured to execute the software 250 stored within the memory 260, to communicate data to and from the memory 260, and to generally control operations of the monitoring station server 106 pursuant to the software 250. The software 250 and the O/S, in whole or in part, but typically the latter, are read by the processor 240, perhaps buffered within the processor 240, and then executed.

When the monitoring station server 106 is implemented in software 100, as is shown in FIG. 4, it should be noted that the software 250 can be stored on any computer readable medium for use by or in connection with any computer related system or method. In the context of this document, a computer readable medium is an electronic, magnetic, optical, or other physical device or means that can contain or store a computer program for use by or in connection with a computer related system or method. The software 250 can be embodied in any computer-readable medium for use by or in connection with an instruction execution system, apparatus, or device, such as a computer-based system, processor-containing system, or other system that can fetch the instructions from the instruction execution system, apparatus, or device and execute the instructions. In the context of this document, a "computer-readable medium" can be any means that can store, communicate, propagate, or transport the program for use by or in connection with the instruction execution system, apparatus, or device. The computer readable medium can be, for example but not limited to, an electronic, magnetic, optical, electromagnetic, infrared, or semiconductor system, apparatus, device, or propagation medium. More specific examples (a nonexhaustive list) of the computer-readable medium would include the following: an electrical connection (electronic) having one or more wires, a portable computer diskette (magnetic), a random access memory (RAM) (electronic), a read-only memory (ROM) (electronic), an erasable programmable read-only memory (EPROM, EEPROM, or Flash memory) (electronic), an optical fiber (optical), and a portable compact disc read-only memory (CDROM) (optical). Note that the computer-readable medium could even be paper or another suitable medium upon which the program is printed, as the program can be electronically captured, via for instance optical scanning of the paper or other medium, then compiled, interpreted or otherwise processed in a suitable manner if necessary, and then stored in a computer memory.

In an alternative embodiment, where the monitoring station server 106 may be implemented entirely in hardware, the monitoring station server 106 can be implemented with any or a combination of the following technologies, which are each well known in the art: a discrete logic circuit(s) having logic gates for implementing logic functions upon data signals, an application specific integrated circuit (ASIC) having appropriate combinational logic gates, a programmable gate array(s) (PGA), a field programmable gate array (FPGA), etc. For the purposes of illustration, a software implementation of the invention will be described, however, this example in no way should be considered limiting.

Figure 5:
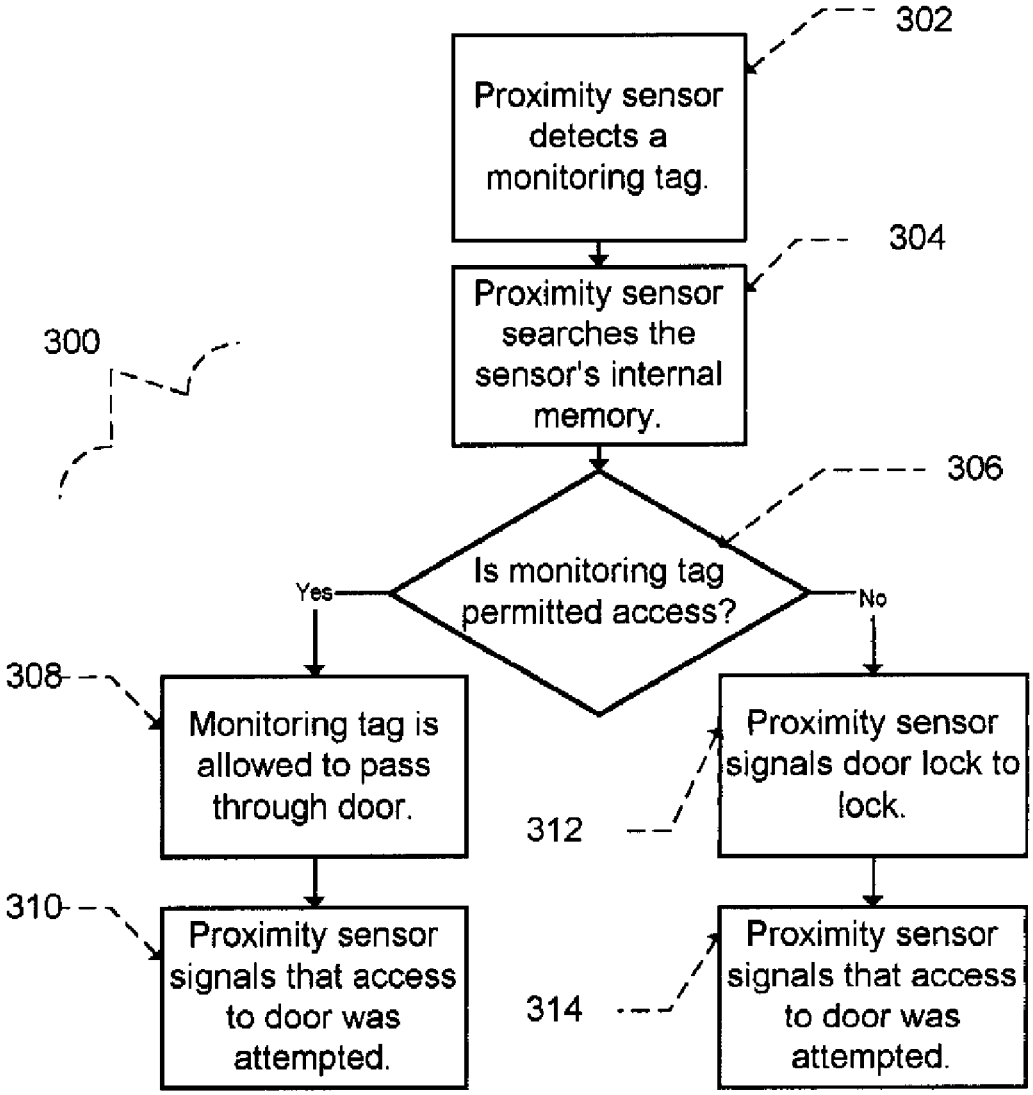
FIG. 5 is a flowchart illustrating a second method of providing access to an entryway within the monitoring system of FIG. 1.

FIG. 5 is a flowchart 300 illustrating a method of providing access to an entryway with the monitoring system 100.

Referring to FIG. 5, when the proximity sensor 206 detects a monitoring tag 102 near the door (block 302), the proximity sensor 206 searches the internal memory of the sensor to determine whether access is permitted (block 304). Specifically, an identification number associated with the monitoring tag 102 is searched for within the internal memory. If the proximity sensor 206 determines (block 306) access is permitted, the monitoring tag 102 is allowed to pass through the door (block 308). The proximity sensor 206 can also signal the monitoring station server 106 indicating that the monitoring tag 102 was allowed access (block 310). If the proximity sensor 206 determines (block 306) that access is not permitted, the proximity sensor 206 directly signals the door lock 218 to lock (block 312). The proximity sensor 206 signals the monitoring station server 106 that the identified monitoring tag 102 attempted access to the door (block 314). The monitoring station server 106 can also provide the proximity sensor internal memory with security updates associated with the monitoring tags 102 that are permitted access to that specific entrance.

Referring again to FIG. 2 and the first exemplary embodiment of the invention, monitoring sensors 208 can also be incorporated into the monitoring devices and sensors 104. The monitoring sensors 208 are positioned throughout the facility being monitored. In addition, the monitoring sensor 208 can be installed within the ceiling or walls of the facility. The monitoring sensor 208 can be installed out of sight of individuals. Each monitoring sensor 208 has a detection region associated with it. The monitoring sensors 208 can detect an identification signal, such as radio frequency (RF) waves, emitted by the monitoring tag 102 when a monitoring tag 102 is within a detection region of a monitoring sensor. The monitoring sensors 208 can then transmit a unique signal associated with the monitoring tag 102 back to the monitoring station server 106. In addition to detecting the identification signal of the monitoring tag 102, the monitoring sensors 208 can also detect the alert signal emitted by the monitoring tag 102. This information is also relayed back to the monitoring station server 106. The monitoring station server 106 uses this information to take corrective action or alert facility staff An array of monitoring sensors 106 can also be used to detect the exact location of a monitoring tag 102. By measuring phase difference between the monitoring sensors 106, the monitoring system 100 can determine the exact location of a monitoring tag 102. This embodiment is described in greater detail in U.S. Pat. No. 6,347,229, and is incorporated herein in its entirety.

Port expanders 210 can also be incorporated into the monitoring system 100. Port expanders 210 allow signals from multiple monitoring devices and sensors 104 to be multiplexed and transmitted to the monitoring station server 106. The monitoring station server 106 then demultiplexes the signals and determines which component transmitted the signal, as an example, via identification numbers. Similarly, zone interface units (shown in the same box as port expanders 210) combine signals from the monitoring devices and sensors 104 located within a zone. For example, a two floor facility may have a first zone which comprises all of the monitoring devices and sensors 104 located on the first floor, and a second zone which comprises all of the monitoring devices and sensors 104 located on the second floor. One zone interface unit would relay signals received from the first floor component back to the monitoring server station 106 and a second zone interface unit would relay signals received from the second floor back to the monitoring server station 106. Both the port expander 210 and zone interface unit feed the signals into the monitoring station server 106.

The monitoring station server 106 runs the software 250 to allow the staff and administration to monitor the individuals within the facility. The monitoring station server 106 tracks the movement of monitoring tags 102 via the signals received from the various monitoring devices and sensors 104 of the monitoring system 100, as are described hereafter. The monitoring station server 106 can perform various predetermined actions in response to signals received from the monitoring devices and sensors 104 of the monitoring system 100. The response actions and pattern of signals to effectuate the response are stored within the database of the monitoring station server 106. Examples of these responses are described in more detail later herein.

Figure 6:
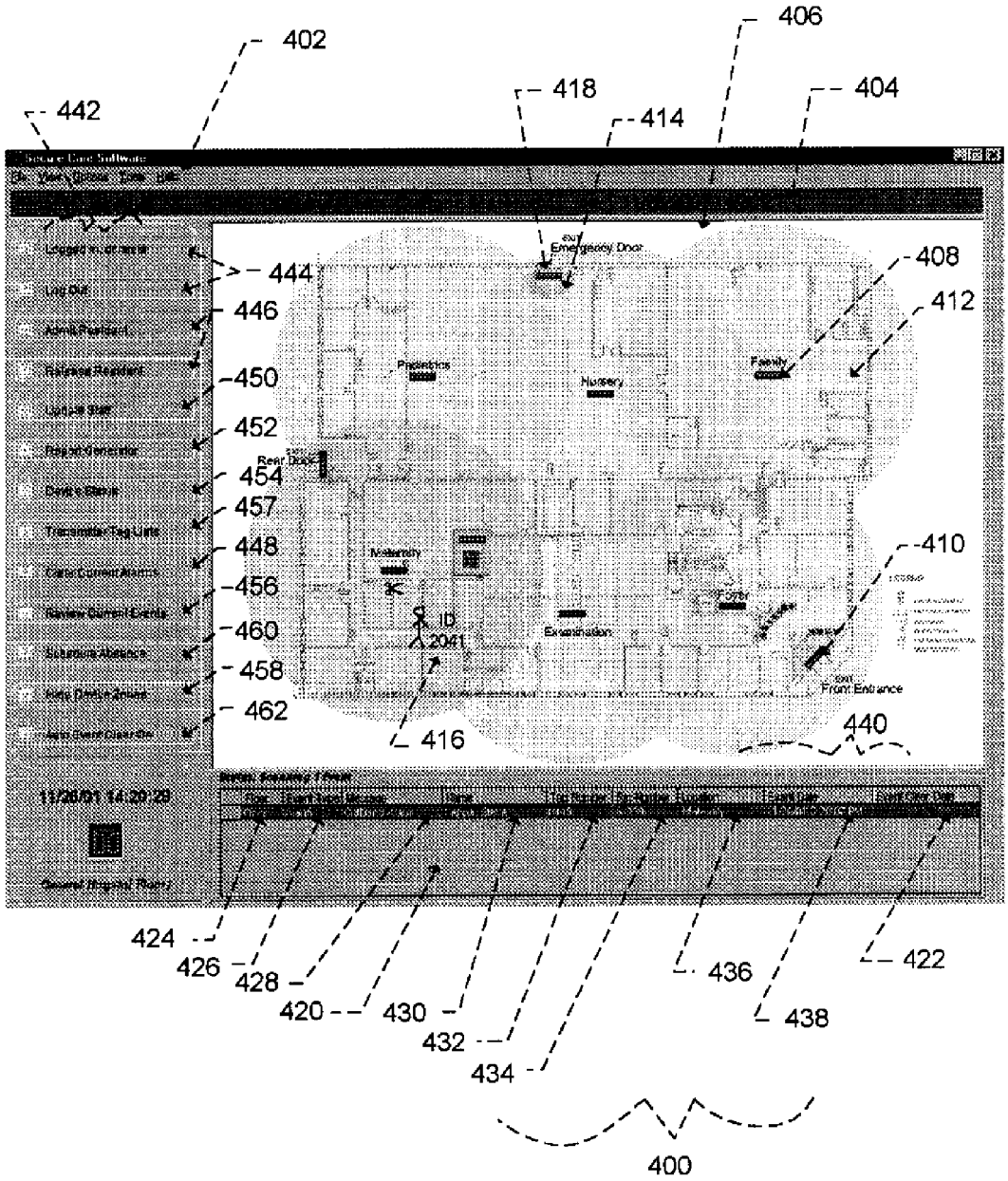
FIG. 6 is a schematic diagram illustrating a user interface of the monitoring system of FIG. 1.

The monitoring station server 106 provides a user interface 400, as is discussed in detail with reference to FIG. 6, to allow the monitoring system 100 to communicate with staff members. Referring to FIG. 2 and FIG. 6, the user interface 400 allows the staff to continually monitor the facility from a remote location. The user interface 400 also allows the staff to program the monitoring station server 106 to respond to a situation or set of received signals from the monitoring devices and sensors 104 with a predetermined action. The staff can also access past events or logged signals to better determine potential situations. For example, the user interface 400 can show that an individual is continually attempting to access a door during different times of the day. This alerts the staff that the individual may be attempting to access the door when it is accidentally unlocked. The details of the user interface 400 are described in greater detail below.

In addition to the monitoring station server 106, monitoring station clients 212 can also be incorporated to allow greater access to the user interface 400 of the monitoring system 100. The monitoring station clients 212 display the same user interface 400 as the monitoring station server 106. The monitoring station server 106 continually updates all of the monitoring station clients 106. With additional monitoring station clients 212, several staff members can simultaneously observe the facility and respond to events. The monitoring station server 106 coordinates with the one or more monitoring station clients 212. For example, one monitoring station client 212 can be installed at the entrance on the first floor of a facility with another monitoring station client 212 installed on the second floor of the facility. The monitoring station server 106 can be located in a security office within the facility. Different staff members can observe an event at different locations and respond quickly to events that are in close proximity or within their specific region of responsibility. The monitoring station server 106 updates the monitoring station clients 212 with information received from the monitoring devices and sensors 104 and updates the monitoring system 100 with responses from all of the monitoring station clients 212. The monitoring system 100 can be incorporated into a typical computer network of servers and workstations. This allows the monitoring system 100 to be incorporated in an existing local area network of the facility. Therefore, structure of the monitoring station clients 212 is similar to structure of the monitoring station server 106.

In addition to displays associated with each monitoring station server 106 and monitoring station clients 212, the monitoring station server 106 can also use stand-alone displays 214 and a variety of alarms 216 to communicate with staff. Audible alarms 216 can be activated in response to certain events. The audible alarms 216 may be a sound that is distinct to the monitoring system 100; for examples the sound may be similar to a bird chirp. The distinct sound helps staff differentiate between the beeps of other device in a busy facility and that of an alert by the monitoring system 100. Silent alarms 216 can also be activated in response to certain events. Displays near entrances can communicate whether access is permitted. Fire alarms 216 can also be incorporated into the monitoring system 100. For example, if the monitoring station server 106 detected that the fire alarm 216 has been activated, the monitoring station server 106 can unlock all exit doors by activating door locks 218 into the unlocked position.

The monitoring system 100 can alert staff of an event by email or page. The user specifies the event to trigger the email or page. The user also specifies the message to be transmitted to the pager or sent via email. The following are examples of message elements that can be transmitted by pager or email.

| Message Element | Description/Source |
|---|---|
| Floor | The floormap where the event happened. |
| Event Type | Alarm or alert. Sent by the device that triggers the event. |
| Message | Brief description of device and event type. |
| Name | Person name (if any) associated with the tag. |
| Tag Number | Tag ID number, as transmitted by the tag. |
| Room Number | The person's room number. |
| Device Type | Sent by the device that triggers the event. |
| Location | The exact location of the event. |
| Event Date | When the event occurred. |

To transmit pages, the monitoring station server 106 sends messages to a third-party pager management system 220 installed on a communication port on the monitoring station server 106. In addition, most pager management systems 220 will expect incoming messages to conform to one of two industry-standard protocols; a first protocol that broadcasts to all pagers or a second protocol that transmits to specific pagers. Accordingly, the user will set up the monitoring station server 106 to transmit the specific protocol depending on whether the user plans to send the message to all of the pagers or to a specific pager.

To transmit emails, the monitoring station server 106 sends the message to a Simple Mail Transfer Protocol (SMTP) server or Microsoft Exchange® server 222. Accordingly, the user will set up the monitoring station server 106 to send the message to a specific email or a group of emails. A variety of emails and pages can be set up to be transmitted for different events.

An alarm button 224 can also be integrated into the monitoring system 100. The alarm button 224 allows the staff to signal the monitoring station server 106 of a change in alert status or to sound an alarm 216. A situation may occur in which the monitoring station server 106 does not detect the need to initiate an alarm 216 or change of security status from the other monitoring devices and sensors 104. The alarm button 224 allows the facility staff to quickly alert the monitoring system 100 of a charge in security status not detected by the monitoring system 100.

The monitoring system 100 can have a variety of configurations. For example, a small facility with one floor and a few people being monitored may merely require a few monitoring sensors and exit components (i.e., contact sensors 204, proximity sensors 206, and door locks 218). In this configuration, a personal computer can function as the monitoring station server 106. In addition, in this configuration, no monitoring station client 212 would be necessary because of the facility size.

A larger facility with three floors may necessitate a dedicated server functioning as the monitoring station server 106. Personal computers already located around the facility can function as monitoring station clients 212. The personal computers and dedicated server would communicate over the current local area network (LAN) of the facility. Even larger facilities can use multiple monitoring station servers 106, in which each monitoring station server 106 would monitor different regions of the facility.

FIG, 6 is a schematic diagram illustrating a user interface 400 of the monitoring system 100. The monitoring station server 106 can communicate to staff members through the user interface 400. The user interface 400 allows the staff to respond to alert situations detected by the monitoring system 100 and to view the movement of individuals with minimal effort. The user interface 400 is displayed on the screen of the monitoring station server 106 and each monitoring station client 212, At the top of the display a typical operating system toolbar 402 can be displayed. Below the toolbar 402 an alert/alarm status display 404 can be used to communicate current situations or alerts. In this example, an alert is displayed on the status display 404 communicating that a monitoring tag 102 has been detached from a user. The status display 404 shows the number of the monitoring tag 102, the location where the alert signal was detected) and the time and date the alert signal was detected. Different background colors of the status display 404 can be used to communicate to the user. A red background can be used to indicate an alarm status that requires immediate attention. A yellow background can be used to indicate an alert that may require attention, while a green background can be used to indicate that the monitoring system 100 is in a normal condition and there are no current situations requiring attention. In addition to background color, other techniques can be used to display information and communicate to a user, for example, but not limited to a flashing display alert and a scrolling display alert. Each of these means of communication may be provided by the software 250 stored within the monitoring station server 106.

A map 406 of the facility being monitored can be displayed below the status display 404. The map 406 of the facility can be used to quickly communicate information to a user. For a large facility, multiple maps 406 can be selected for individual display. For example, a map 406 of the first floor can be displayed on all monitoring stations located on the first floor, while a map 406 of the second floor can be displayed on all computers located on the second floor.

Monitoring sensor icons 408 and proximity sensor icons 410 can be displayed on the map 406 in locations corresponding to their locations in the facility. Door icons 418 can also be displayed on the map 406. Surrounding the monitoring sensor icons 408 are monitoring detection regions 412 represented as shaded circles and semicircles depicting the proximity detection regions 414 of the proximity sensors 410. The user interface 400 can also be set to hide the proximity sensors icons 410, monitoring sensor icons 408, and detection regions 412 414. The staff members may choose to hide the location of the device for security reasons.

In addition to displaying the above icons, monitoring tag icons 416 can also be displayed on the map 406 in locations corresponding to the region of the facility where the monitoring tag 102 is detected. This allows the staff member to track movement throughout the facility with little effort. The map 406 can also be used to notify the staff members of alert or alarm situations. For example, the monitoring detection region 412 on the map 406 can change colors. The monitoring detection region 412 can be a shade of green when there are no situations within a monitoring detection region 412. The monitoring detection region 412 can change to a shade of yellow when there is an alert situation within the monitoring detection region 412 or a shade of red when there is an alarm situation within the monitoring detection region 412. If the user sets the icons and monitoring detection regions 412 to be hidden from display, the monitoring detection region 412 can remain hidden until a potential situation occurs within the monitoring detection region 412. The monitoring detection region 412 can become visible on the map 406 to alert staff members to the situation. Other techniques can be used to display information and communicate to a user, for example, but not limited to, flashing icons, textual descriptions on the map, and changes in color or shade of the map 406. In addition to changing colors of monitoring detection regions 412, the icons on the map 406 can also change colors. For example, but not limited to, a red door icon can represent a locked door while a green door icon can represent an unlocked door.

An event log 420 can be displayed below the map 406. The event log 420 displays a list of events that previously occurred. Each row 422 is a specific event with information fields relevant to the event displayed in the columns. The following are examples of event fields. A floor column 424 identifies the floor in the facility where the event occurred. The event type column 426 describes the type of event that occurred, for example, door access attempted. A message column 428 can be used to communicate additional information about the event, for example, "check door". A name column 430 and tag number column 432 can display the monitoring tag number that caused the event and the respective name of the individual associated with the tag. A room number column 434 and location column 436 can be displayed to communicate the location of the event. A date and time column 438 can also be displayed. The date and time the event was cleared column 440 can also be displayed. All of this information and more can be communicated to staff through the event log 420. This allows the staff to identify possible trends, for example, if three different events show the same individual attempting to open the same door, staff may be alerted that the individual is trying to gain access to that door. The fields in the event log 420 are not limited to the above discussed fields; the user can create a variety of event fields for display. In addition, the user may also select the quantity of past events displayed. A user can limit the number of events displayed by setting a time period for past events, for example, the user can select to display all events that occurred in the past four hours. The event log 420 allows staff to view past events that would be relevant to current or future events.

Selection buttons 442 can also be displayed next to the map 406 of the facility. The selection buttons 442 allow a user to update and adjust the monitoring system 100 and respond to situation alerts. The following are examples of selection buttons 442; however, the system is not limited to just the following selection buttons 442. A variety of other selection buttons 442 can be incorporated as will be apparent.

Login and logout buttons 444 allow users to log onto the monitoring system 100 The user enters a user name and password. The monitoring station server 106 verifies the correct user name and password and then gives the user access to the monitoring system 100 if authorized. When the user has completed the intended task, the user logs out of the system 100 by selecting the logout button 444. The system 100 also includes an inactive timed log out. If a user logs into the system 100 and does not log off, the system 100 may automatically log the user off after a period of inactivity by the user. The administrator can set the length of time for the period of inactivity. This prevents an unintended user from gaining access to the system when a legitimate user fails to log out of the system. In addition, the system also will automatically log a previous user off when a new user attempts to log on to the same computer. This avoids the step of a user having to log off before another user logs on.

Figure 7:
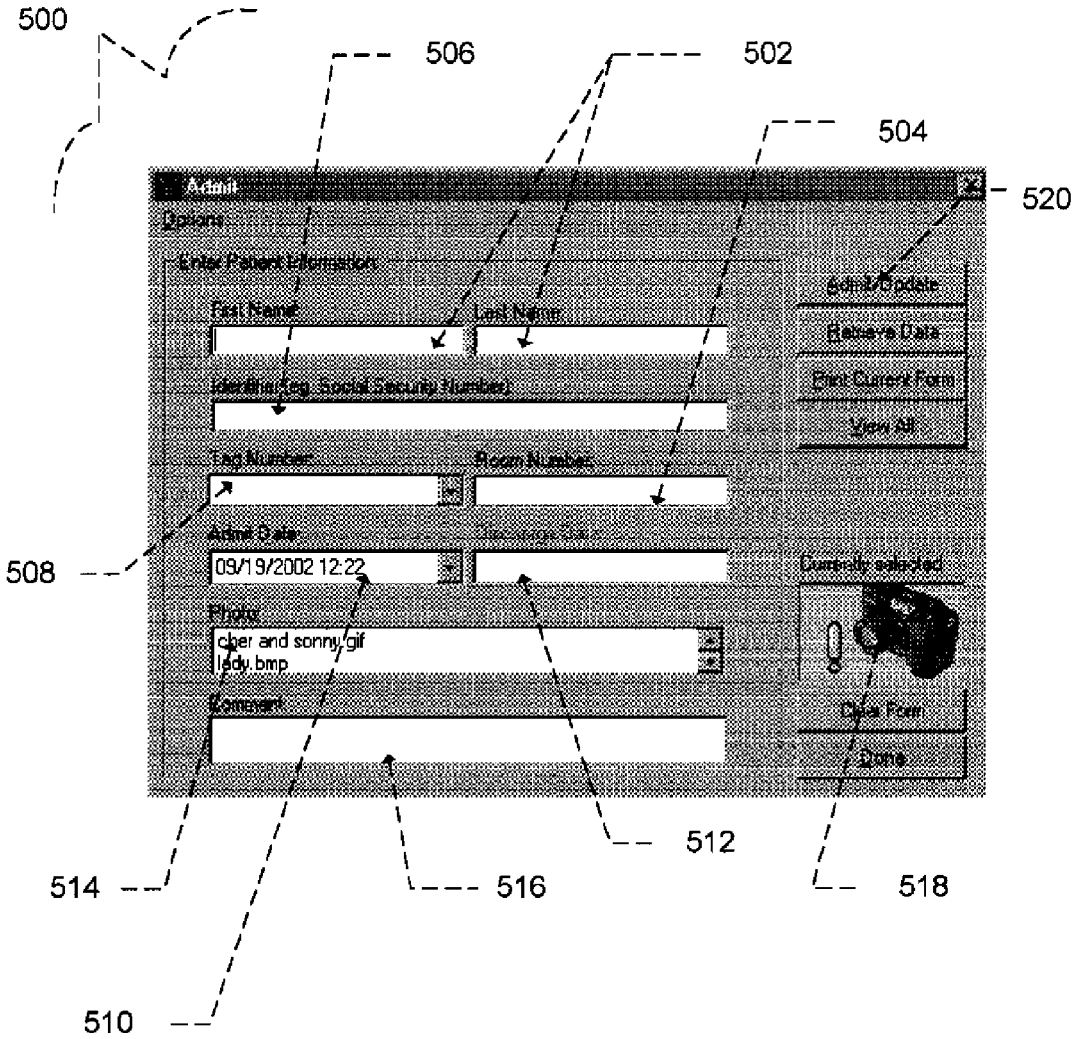
FIG. 7 is a schematic diagram illustrating an admittance and release form of the monitoring system of FIG. 1.

Admittance and release buttons 446 allow access to an admittance and release form 500 (FIG. 7), which allows the user to enter, clear, or edit the information of a person being monitored. FIG. 5 is a schematic diagram illustrating an admittance and release form 500 of the monitoring system 100. The admittance and release form 500 has fields for the name of a person 502; a room number field 504, for example, the number of the room where the individual is staying; and a field for identification 506, for example, a social security number or home phone number. The admittance and release form 500 also has a field for the monitoring tag number 508 associated with the monitoring tag 102 the individual will be wearing. Admittance date 510 and discharge date 512 can also be entered, which correspond to the date a person was granted access to the facility and the date access was removed. The monitoring system 100 can use these dates to determine when access limitations should be changed. For example, an individual may not be allowed access to a portion of a facility after they have been discharged from the facility. The admittance and release form 500 also allows a user to include a photograph file of the individual 514 along with comments 516 that are specific to the individual. The selected photograph of the individual 514 is displayed in a photo field 518 on the admittance and release form 500. After completing the data fields the user submits the form via selection of an Update button 520. The monitoring station server 106 updates the databases based on the new information.

Referring back to FIG. 6, the event clear button 448 allows a staff member to clear a current alert or alarm. When a staff member observes an alert or alarm situation the staff member follows predetermined facility procedures. Once the staff member has determined that the alert or alarm situation has been properly handled, the event can be cleared by selecting the event clear button 448.

Figure 8:
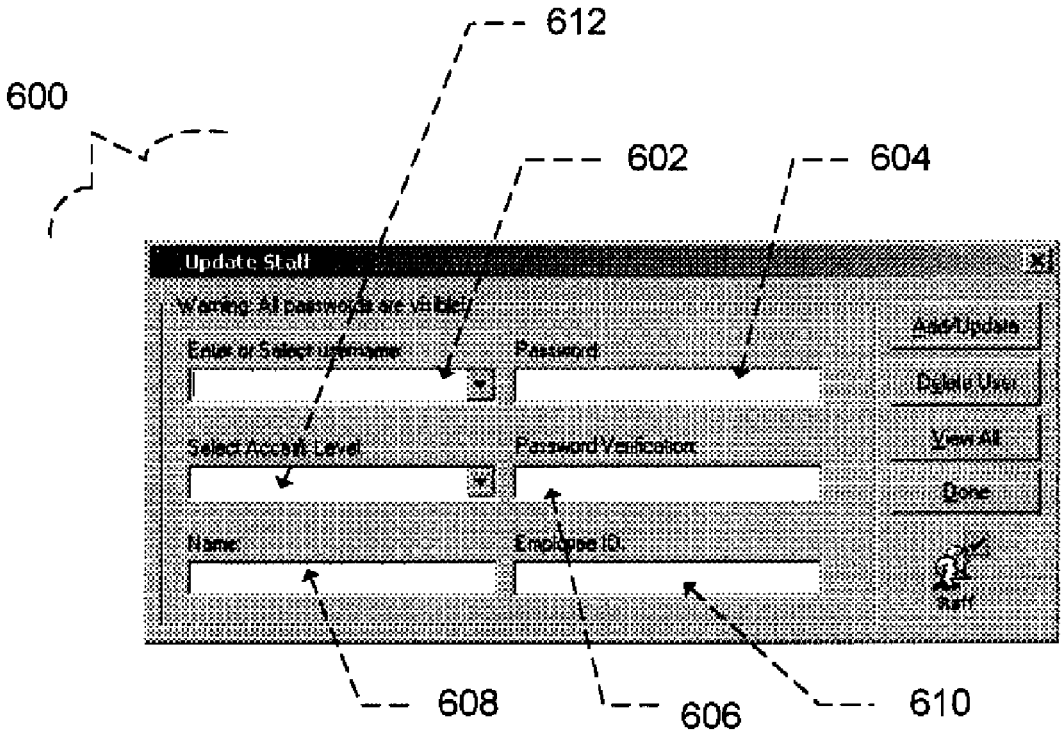
FIG. 8 is a schematic diagram illustrating an update staff form of the monitoring system of FIG. 1.

The update staff button 450 accesses an update staff form 600, which allows the user to enter, clear, or edit the information of a staff member. FIG. 8 is a schematic diagram illustrating an update staff form 600 of the monitoring system 100. The update staff form 600 allows a user to update information associated with a staff member. The staff form has a user name field 602 to enter a user name associated with the staff member. The update staff form 600 also has a password field 606 to enter the staff member's password and a password verification field 608 to reenter the password to verify the password has been entered correctly. The update staff form 600 also has a name field 608 to enter the name of the staff member as well as an employee ID field 610 to enter other pertinent information, such as the employee ID number of the staff member. An access level field 612 allows the user to select the level of access to be given to the staff member. The monitoring system 100 breaks access down into three levels. A guest level allows a user to log in and out, view floor plans, and generate reports. A user level includes guest level access in addition to managing data, clearing alerts and alarms, and updating the door locking schedule. An administrator level includes all user level access in addition to managing staff data, system setup, backing up the system, and restoring databases. Based on these levels of access only an administrator would be allowed to gain access to the update staff forms 600. Of course, other access levels may be provided. In addition to updating staff forms 600, the administrator is the only person allowed access to shutdown the monitoring system 100. The monitoring system 100 runs within the operating system. An individual is prevented from accessing the operating system and shutting down the monitoring system 100 without administrator level access. This prevents an individual from tampering with the monitoring system 100 by accessing the operating system or the computer running the operating system.

Referring back to FIG. 6, the reports generator button 452 allows users to print or send reports created by the system. The user specifies a period of time associated with the report and the type of report the user wishes to generate. Below are examples of reports that can be generated by the monitoring system 100 along with a description and comments associated with each specific report. The following reports are examples of reports that can be generated.

| Report Name | Description/Comments |
|---|---|
| Current Person Report | Describes persons who have been admitted but not discharged. |
| Door Locking Status Report | Shows when exits are scheduled to be automatically locked/unlocked. |
| Installed Device Summary | Describes all installed devices. |
| Person History Report | Describes all persons, including those who have been discharged. |
| Person Tag Assignments | Shows person-tag assignments. Can be sorted by name or tag number. |
| Scheduled Absence Report | Shows scheduled absences of persons. |
| Status Log History Report | Shows all events within a selected date range. |
| Tag Expiration Report | Shows expiration dates of all tags which have been entered in tag lists. |
| Tag Reorder Report | Shows expiration dates of all tags which have been entered in tag lists and which will expire within the next thirty days. |
| User Access Report | Describes each user. Includes (in an Approved By column) the ID of the ADMIN user who added the user to the system. Includes a Permissions column for use by support personnel. |

The device status button 454 allows the user to view the network of monitoring devices and sensors 104 of the monitoring system 100 and their current status. The review current events button 456 allows the user to view a list of current events. The transmitter tag list button 457 allows the user to quickly view a list of monitoring tags 102 and the individuals associated with each monitoring tag 102. The hide device zone button 458 allows a user to hide the monitoring detection regions 412 on the map 406. For security purposes a facility may wish to hide the detection zones to prevent an individual from using the information to avoid detection. The schedule absence button 460 allows a user to enter a period of absence for an individual being monitored. This allows the individual to remain in the monitoring system 100; however, the monitoring system 100 can change access status during the period of scheduled absence. The auto event clear button 462 allows the user to set the monitoring system 100 to automatically clear the event from the monitoring system 100 when the monitoring devices and sensors 104 that detected the event have been reset. This facilitates resetting the monitoring system 100 by not requiring the staff to reset monitoring devices and sensors 104 and clear the event in the monitoring system 100.

The monitoring system 100 can have a variety of responses that are tailored to specific requirements for each facility. In one example, a proximity sensor 206 detects a monitoring tag 102 wandering near an exit door. The monitoring station server 106 determines that the individual associated with the monitoring tag 102 is not permitted access to the exit door. The monitoring station server 106 activates the door lock 218 of the exit door. The monitoring station server 102 updates the event log 420 with the new event. The event is also represented graphically on the map 406. The individual attempts to open the locked exit door. The user interface 400 goes into alert mode. The user interface 400 stays in alert mode until a staff member responds and clears the event. A typical facility response procedure for this example may require a staff member to check on the individual associated with the monitoring tag 102 that caused the alert. Once the staff has followed the procedures of the facility, a user clears the event. The user interface 400 then goes back to normal operating mode and the event appears in the event log 420 as cleared.

In another example, a proximity sensor 206 detects a monitoring tag 102 wandering near an exit door. The monitoring station server 106 determines that the individual associated with the monitoring tag 102 is not permitted access to the exit door. In this example, the monitoring station server 106 does not lock the exit door; however, the monitoring station server 106 updates the event log 420 with the new event. The event is also represented graphically on the map 406. The user interface 400 goes into alert mode. However, in this example the individual does not attempt to open the door and proceeds away from the door. The user interface 400 stays in alert mode until a staff member responds and clears the event. The proximity sensor 206 determines that the monitoring tag 102 has moved away from the door and transmits the update to the monitoring station server 106. The user interface 400 automatically goes back to normal operating mode and the event appears in the event log 420.

In another more severe example, the monitoring sensor 208 detects an alarm signal from a monitoring tag 102 and transmits it to the monitoring station server 106. The monitoring station server 106 activates the locks 218 on all exit doors of the facility and the user interface 400 goes into alarm mode. The monitoring station server 106 may also activate a silent alarm and/or transmit pages or emails to staff members. The monitoring sensor 208 may also detect the ID signal of the monitoring tag 102 and transmit it to the monitoring station server 106. The monitoring station server 106 identifies the individual associated with the monitoring tag 102. The monitoring station server 106 updates the event log 420 with the new event. The event is also represented graphically on the map 406 with the tag icons 416 and text identifying the person associated with the monitoring tag 102 in a location on the map 406 associated with the current location of the monitoring tag 102. The user interface 400 stays in alarm mode until a staff member clears the event. Once the staff has followed the procedures of the facility for responding to the alarm, a user can clear the event. The user interface 400 then goes back to normal operating mode and the event appears in the event log 420 as cleared.

The monitoring system 100 can be tailored to detect and respond to a wide range of facilities. Using a variety of monitoring devices and sensors 104, the monitoring station server 106 can detect events occurring within a facility and possible future events. Using the user interface 400, alarms, pagers and email, the monitoring station server 106 can alert staff members of events that are unfolding within the facility. For example, a hospital can prevent abduction of infants and pediatric patients by using the monitoring system 100 to monitor the infants and pediatric patients' movement throughout the facility. The monitoring system 100 can be easily adapted to a psychiatric care facility. By using the monitoring system 100 to monitor clients, an individual with dementia can be prevented from wandering off the grounds of the facility. In another previously described example, the monitoring system 100 can also be adapted to prevent radioactive material from leaving hospital grounds.

It should be emphasized that the above-described embodiments and examples of the present invention are merely possible, examples of implementations, merely set forth for a clear understanding of the principles of the invention. Many variations and modifications may be made to the above-described embodiment(s) of the invention without departing substantially from the spirit and principles of the invention. All such modifications and variations are intended to be included herein within the scope of this disclosure and the present invention and protected by the following claims.

What is claimed is:

1. A monitoring system comprising:

one or more monitoring tags wherein each monitoring tag continuously emits an identifier signal unique to each monitoring tag and each monitoring tag is wired to transmit a non-continuous alert signal, wherein the alert signal is more powerful than the identifier signal, one or more monitoring sensors wherein one or more of the monitoring sensors receive signals from the one or more monitoring tags and relay the signals to one or more monitoring stations, and one or more monitoring stations wherein the one or more monitoring stations log and display information associated with the signals received from the one or more monitoring sensors.

2. The monitoring system of claim 1, wherein at least one monitoring station identifies a situation based on the received signal.

3. The monitoring system of claim 1, wherein at least one monitoring station displays a floor plan of a monitored area.

4. The monitoring system of claim 2, wherein at least one monitoring station displays an alert icon on a floor plan based on the situation.

5. The monitoring system of claim 2, wherein at least one monitoring station sounds an audible alert based on the situation.

6. The monitoring system of claim 2, wherein at least one monitoring station sends an email based on the situation.

7. The monitoring system of claim 1, wherein the monitoring tags are attached to people.

8. The monitoring system of claim 1, wherein the monitoring tags are attached to items.

9. The monitoring system of claim 1, wherein each monitoring tag has a means for connecting and the alert signal is emitted by the monitoring tag when the means for connecting is broken.

10. The monitoring system of claim 1, wherein one or more monitoring sensors are proximity sensors.

11. The monitoring system of claim 1, wherein the monitoring tag comprises a connecting strap with a closed circuit and emits an the alert signal when the strap is broken and the circuit is opened.

12. The monitoring system of claim 11, wherein the closed circuit encircles an extremity of a person being monitored.

13. The monitoring system of claim 1, wherein each monitoring tag has a connecting means and the alert signal is emitted when the connecting means is disconnected.

14. The monitoring system of claim 1, wherein the one or more monitoring stations uses the identifier signal to search a monitoring tag database for additional information and displays the additional information relating to the specific identifier signal.

15. The monitoring system of claim 1, further comprising:

one or more door locks wherein at least one monitoring station is programmed to lock at least one door in response to the alert signal.

16. The monitoring system of claim 15, wherein at least one monitoring station is programmed to lock at least one door in response to the one or more identifier signals.

17. The monitoring system of claim 15, wherein at least one monitoring station is programmed to use the one or more identifier signals to search a monitoring tag database for additional information and lock at least one of the doors based on the additional information.

18. The monitoring system of claim 1, wherein the one or more monitoring stations communicate with each other over an existing local area network.

19. The monitoring system of claim 1, wherein one of the one or more monitoring stations is a monitoring station server that coordinates the monitoring system's activities with the other one or more monitoring stations.

20. A monitoring system comprising:

one or more means for identifying wherein each means for identifying emits an identifier signal unique to each means for identifying, one or more means for alerting, wherein each means for alerting is integral with each means for identifying and wherein each means for alerting emits an alert signal more powerful than the identifier signal, one or more means for sensing wherein one or more of the means for sensing receives signals from the one or more means for identifying and relays the signals to one or more means for monitoring, and one or more means for monitoring wherein at least one means for monitoring logs and displays data associated with the signals received from the one or more means for monitoring.

21. The monitoring system of claim 20, wherein at least one means for monitoring displays a floor plan of a monitored area.

22. The monitoring system of claim 20, wherein at least one means for monitoring displays an alert icon on a floor plan.

23. The monitoring system of claim 20, wherein at least one means for monitoring sounds an audible alert.

24. The monitoring system of claim 20, wherein at least one means for monitoring sends an email.

25. The monitoring system of claim 20, wherein the means for identifying are attached to people.

26. The monitoring system of claim 20, wherein the means for identifying are attached to items.

27. The monitoring system of claim 20, wherein each means for identifying has a means for connecting and the alert signal is emitted when the means for connecting is broken.

28. The monitoring system of claim 20, wherein each means for identifying has a means for connecting and the alert signal is emitted when the means for connecting is disconnected.

29. The monitoring system of claim 20, wherein at least one means for monitoring uses the identifier signal to search a monitoring tag database for additional information and displays the additional information relating to the specific identifier signal.

30. The monitoring system of claim 20, further comprising:

one or more means for locking wherein at least one means for monitoring activates at least one means for locking to lock at least one path of egress closed.

31. The monitoring system of claim 30, wherein at least one means for monitoring activates one or more of the means for locking based on the one or more of the means for sensing receiving the one or more identifier signals, and wherein activating one or more of the means for locking locks at least one path of egress closed.

32. The monitoring system of claim 30, wherein the one or more means for monitoring uses the one or more identifier signals to search a monitoring tag information database and activates one or more of the means for locking based on the additional information.

33. A method of monitoring comprising:

receiving a unique identifier signal from each of one or more monitoring tags, receiving an alert signal from one or more monitoring tags, wherein the alert signal is more powerful than the identifier signal, identifying a situation based on one of the identifier signals and the alert signal, and storing and displaying information about the situation.

34. The monitoring method of claim 33, further comprising displaying a floor plan of a monitored area.

35. The monitoring method of claim 34, further comprising displaying an alert icon on a floor plan associated with the situation.

36. The monitoring method of claim 33, further comprising sounding an audible alert associated with the situation.

37. The monitoring method of claim 33, further comprising sending an email associated with the situation.

38. The monitoring method of claim 33, further comprising using the identifier signal to search a monitoring tag database for additional information relating to the specific identifier signal.

39. The monitoring method of claim 38, further comprising activating one or more door locks in response to the additional information retrieved from the monitoring tag database.

40. The monitoring method of claim 33, further comprising activating one or more door locks in response to the situation.

* * * * *

UNITED STATES PATENT AND TRADEMARK OFFICE

CERTIFICATE OF CORRECTION

PATENT NO. : 7,468,666 B2
APPLICATION NO. : 11/610557
DATED : December 23, 2008
INVENTOR(S) : Ciarcia et al.

It is certified that error appears in the above-identified patent and that said Letters Patent is hereby corrected as shown below:

Col. 16, Claim 11, Line 43, after “emits”, delete --an--

Signed and Sealed this

Twenty-eighth Day of April, 2009

John Doll

JOHN DOLL
*Acting Director of the United States Patent and Trademark Office*